US007850423B2

(12) United States Patent
Yamashita

(10) Patent No.: US 7,850,423 B2
(45) Date of Patent: Dec. 14, 2010

(54) STEAM TURBINE AND TURBINE ROTOR

(75) Inventor: Katsuya Yamashita, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 851 days.

(21) Appl. No.: 11/739,358

(22) Filed: Apr. 24, 2007

(65) Prior Publication Data

US 2007/0253812 A1 Nov. 1, 2007

(30) Foreign Application Priority Data

Apr. 26, 2006 (JP) ..... 2006-121411

(51) Int. Cl.
*F04D 29/44* (2006.01)

(52) U.S. Cl. ..... 415/199.1; 415/199.4; 415/200; 415/216.1; 416/61; 416/198 A; 416/201 R; 416/213 R; 416/244 A

(58) Field of Classification Search ..... 415/199.4, 415/200, 216.1, 199.1; 416/61, 198 A, 201 R, 416/213 R, 244 A
See application file for complete search history.

(56) References Cited

U.S. PATENT DOCUMENTS

| | | | | |
|---|---|---|---|---|
| 5,257,905 | A | 11/1993 | Wynn et al. | |
| 6,152,697 | A * | 11/2000 | Konishi et al. | 416/213 R |
| 6,358,004 | B1 * | 3/2002 | Shiga et al. | 415/200 |
| 7,267,525 | B2 | 9/2007 | Hiegemann et al. | |
| 2004/0234371 | A1 | 11/2004 | Palmer et al. | |
| 2004/0261417 | A1 | 12/2004 | Yamashita et al. | |
| 2005/0022527 | A1 | 2/2005 | Nagane et al. | |
| 2005/0118025 | A1 | 6/2005 | Hiegemann et al. | |
| 2008/0159849 | A1 | 7/2008 | Heine et al. | |

FOREIGN PATENT DOCUMENTS

| | | | |
|---|---|---|---|
| CN | 1573020 | A | 2/2005 |
| EP | 1 378 629 | A1 | 1/2004 |
| EP | 1 536 102 | A2 | 6/2005 |
| EP | 1 577 494 | A1 | 9/2005 |
| JP | 7-247806 | A | 9/1995 |
| JP | 2000-282808 | A | 10/2000 |
| JP | 2001-82109 | A | 3/2001 |
| JP | 2004-353603 | A | 12/2004 |
| WO | WO 2005/093218 | A1 | 10/2005 |

* cited by examiner

*Primary Examiner*—Igor Kershteyn
(74) *Attorney, Agent, or Firm*—Foley & Lardner LLP

(57) ABSTRACT

High-temperature steam at 620° C. or higher is introduced to a reheat steam turbine 100, and a turbine rotor 113 of the reheat steam turbine 100 includes: a high-temperature turbine rotor constituent part 113*a* positioned in an area extending from a nozzle 114*a* on a first stage to a moving blade 115*a* on a stage where temperature of the steam becomes 550° C. and made of a corrosion and heat resistant material; and low-temperature turbine rotor constituent parts 113*b* connected to and sandwiching the high-temperature turbine rotor constituent part 113*a* and made of a material different from the material of the high-temperature turbine rotor constituent part 113*a*.

7 Claims, 6 Drawing Sheets

STEAM TURBINE AND TURBINE ROTOR

CROSS-REFERENCE TO RELATED APPLICATIONS

This application is based upon and claims the benefit of priority from the prior Japanese Patent Application No. 2006-121411, filed on Apr. 26, 2006; the entire contents of which are incorporated herein by reference.

BACKGROUND

1. Field of the Invention

The present invention relates to a steam turbine and a turbine rotor, more particularly, to a steam turbine and a turbine rotor allowing the use of high-temperature steam at 620° C. or higher.

2. Description of the Related Art

For most of high-temperature parts in thermal power generation facilities, ferritic heat resistant steels excellent in manufacturing performance and economic efficiency have been used. A steam turbine of such a conventional thermal power generation facility is generally under a steam temperature condition on order of not higher than 600° C., and therefore, its major components such as a turbine rotor and moving blades are made of ferritic heat resistant steel.

However, in recent years, improvement in efficiency of thermal power generation facilities have been actively promoted from a viewpoint of environmental protection, and steam turbines utilizing high-temperature steam at about 600° C. are operated. Such a steam turbine includes components requiring characteristics that cannot be satisfied by characteristics of the ferritic heat resistant steel, and therefore, these components are sometimes made of a heat resistant alloy or austenitic heat resistant steel more excellent in high-temperature resistance.

For example, JP-A 7-247806 (KOKAI), JP-A 2000-282808 (KOKAI), and Japanese Patent No. 3095745 describe arts to construct a steam turbine power generation facility with the minimum use of an austenitic material for a steam turbine utilizing high-temperature steam at 650° C. or higher. For example, in the steam turbine power generation facility described in JP-A 2000-282808 (KOKAI), a superhigh-pressure turbine, a high-pressure turbine, an intermediate-pressure turbine, a low-pressure turbine, a second low-pressure turbine, and a generator are uniaxially connected, and the super high-pressure turbine and the high-pressure turbine are assembled in the same outer casing and thus are independent from the others.

Further, in view of global environmental protection, a need for higher efficiency enabling a reduction in emissions of $CO_2$, SOx, and NOx is currently increasing. One of the most effective plans to enhance plant thermal efficiency in a thermal power generation facility is to increase steam temperature, and the development of a steam turbine on order of 700° C. is under consideration.

Further, for example, JP-A 2004-353603 (KOKAI) describes an art to cool turbine components by cooling steam in order to cope with the aforesaid increase in the steam temperature.

In the development of the aforesaid steam turbine on order of 700° C., how strength of, in particular, turbine components can be ensured is currently groped for. In thermal power generation facilities, improved heat resistant steel has been conventionally used for turbine components such as a turbine rotor, nozzles, moving blades, a nozzle box (steam chamber), and a steam supply pipe included in a steam turbine, but when the temperature of reheated steam becomes 700° C. or higher, it is difficult to maintain high level of strength guarantee of the turbine components.

Under such circumstances, there is a demand for realizing a new art that is capable of maintaining high level of strength guarantee of turbine components even when conventional improved heat resistant steel is used as it is for the turbine components in a steam turbine. One prospective art to realize this is to use cooling steam for cooling the aforesaid turbine components. However, to cool a turbine rotor and a casing by the cooling steam in order to use the conventional material for portions, for instance, corresponding to and after a first-stage turbine, a required amount of the cooling steam amounts to several % of an amount of main steam. Moreover, since the cooling steam flows into a channel portion, there arises a problem of deterioration in internal efficiency of a turbine itself in accordance with deterioration in blade cascade performance.

BRIEF SUMMARY OF THE INVENTION

The present invention was made to solve the above problems, and its object is to provide a steam turbine and a turbine rotor which can be driven by high-temperature steam to have improved thermal efficiency and which are excellent in economic efficiency, by using a corrosion and heat resistant material limitedly for predetermined turbine components.

According to an aspect of the present invention, there is provided a steam turbine to which high-temperature steam at 620° C. or higher is introduced, the steam turbine including a turbine rotor including: a high-temperature turbine rotor constituent part positioned in an area extending from a nozzle on a first stage to a moving blade on a stage where temperature of the steam becomes 550° C. and made of a corrosion and heat resistant material; and low-temperature turbine rotor constituent parts connected to and sandwiching the high-temperature turbine rotor constituent part and made of a material different from the material of the high-temperature turbine rotor constituent part.

According to another aspect of the present invention, there is provided a turbine rotor penetratingly provided in a steam turbine to which high-temperature steam at 620° C. or higher is introduced, including: a high-temperature turbine rotor constituent part positioned in an area extending from a nozzle on a first stage in the steam turbine to a moving blade on a stage where temperature of the steam becomes 550° C. and made of a corrosion and heat resistant material; and low-temperature turbine rotor constituent parts connected to and sandwiching the high-temperature turbine rotor constituent part and made of a material different from the material of the high-temperature turbine rotor constituent part.

BRIEF DESCRIPTION OF THE DRAWINGS

The present invention will be described with reference to the drawings, but these drawings are provided only for an illustrative purpose and in no way are intended to limit the present invention.

DETAILED DESCRIPTION OF THE INVENTION

Herein after, embodiments of the present invention will be described with reference to the drawings.

First Embodiment

Figure 1:
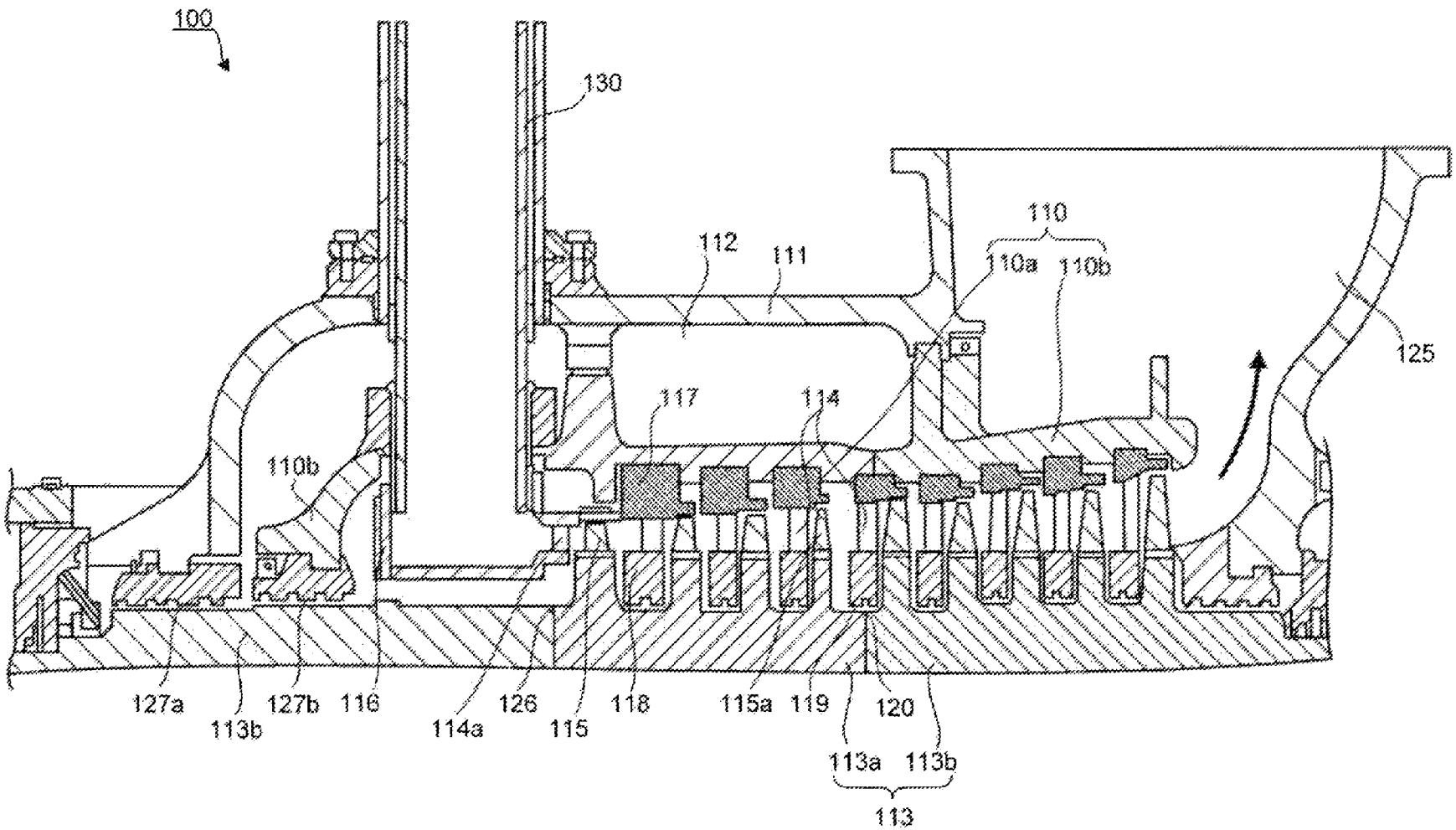
FIG. 1 is a view showing a cross section of an upper casing part of a reheat steam turbine of a first embodiment.

FIG. 1 is a view showing a cross section of an upper casing part of a reheat steam turbine 100 of a first embodiment.

As shown in FIG. 1, the reheat steam turbine 100 includes a dual-structured casing composed of an inner casing 110 and an outer casing 111 provided outside the inner casing 110, and a heat chamber 112 is formed between the inner casing 110 and the outer casing 111. A turbine rotor 113 is penetratingly provided in the inner casing 110. Further, nozzle diaphragm outer rings 117 are connected to an inner surface of the inner casing 110, and for example, nine-stages of nozzles 114 are provided. Further, moving blades 115 are implanted in the turbine rotor 113 so as to correspond to these nozzles 114.

This turbine rotor 113 is composed of: a high-temperature turbine rotor constituent part 113*a* positioned in an area extending from a nozzle 114*a* on a first stage (where steam temperature is 620° C. or higher) to a moving blade 115*a* on a stage where the steam temperature becomes 550° C.; and low-temperature turbine rotor constituent parts 113*b* connected to and sandwiching the high-temperature turbine rotor constituent part 113*a*. The high-temperature turbine rotor constituent part 113*a* and each of the low-temperature turbine rotor constituent parts 113*b* are connected by welding or bolting. The structure of a joint portion therebetween will be described later. Here, the aforesaid inner casing 110 is composed of: a high-temperature casing constituent part 110*a* covering the area where the high-temperature turbine rotor constituent part 113*a* is penetratingly provided; and low-temperature casing constituent parts 110*b* covering the areas where the low-temperature turbine rotor constituent parts 113*b* are penetratingly provided. The high-temperature casing constituent part 110*a* and each of the low-temperature casing constituent parts 110*b* are connected by welding or bolting, similarly to the aforesaid connection of the high-temperature turbine rotor constituent part 113*a* and each of the low-temperature turbine rotor constituent parts 113*b*.

The high-temperature turbine rotor constituent part 113*a* and the high-temperature casing constituent part 110*a* positioned in the area extending from the nozzle 114*a* on the first stage to the moving blade 115*a* on the stage where the steam temperature becomes almost 550° C. (strictly speaking, it may be a temperature near 550° C.) are exposed to high-temperature steam at 620° C. or higher, which is an inlet steam temperature, and steam up to 550° C., and therefore are made of a corrosion and heat resistant material or the like whose mechanical strength (for example, a hundred thousand hour creep rupture strength) at high temperatures is high and which has steam oxidation resistance. As the corrosion and heat resistant material, for example, a Ni-based alloy is used, and concrete examples thereof are Inco625, Inco617, Inco713, and the like manufactured by Inco Limited. The nozzles 114, the nozzle diaphragm outer rings 117, nozzle diaphragm inner rings 118, the moving blades 115, and so on positioned in the area extending from the nozzle 114*a* on the first stage to the moving blade 115*a* on the stage where the steam temperature becomes 550° C. are also made of the aforesaid corrosion and heat resistant material.

The low-temperature turbine rotor constituent parts 113*b* and the low-temperature casing constituent parts 110*b* exposed to the steam at temperatures lower than 550° C. are made of a material different from the aforesaid material forming the high-temperature turbine rotor constituent part 113*a* and the high-temperature casing constituent part 110*a*, and are preferably made of ferritic heat resistant steel or the like which has conventionally been in wide use as a material of a turbine rotor and a casing. Concrete examples of this ferritic heat resistant steel are new 12Cr steel, modified 12Cr steel, 12Cr steel, 9Cr steel, CrMov Steel and the like but are not limited to these.

Further, nozzle labyrinths 119 are provided on turbine rotor 113 side surfaces of the nozzle diaphragm inner rings 118 to prevent leakage of the steam.

The reheat steam turbine 100 further has a steam inlet pipe 130 which penetrates the outer casing 111 and the inner casing 110 and whose end portion communicates with and connected to a nozzle box 116 guiding the steam out to a moving blade side. These steam inlet pipe 130 and nozzle box 116 are exposed to the high-temperature steam at 620° C. or hither which is the inlet steam temperature, and therefore are made of the aforesaid corrosion and heat resistant material. Here, the nozzle box 116 may have a structure, for example, disclosed in JP-A No. 2004-353603 (KOKAI), that is, a cooling steam channel in which cooling steam flows is formed in a wall of the nozzle box and shield plates are provided at intervals to cover parts of an inner surface of the wall of the nozzle box. This can reduce thermal stress and the like occurring in the wall of the nozzle box, so that high level of strength guarantee can be maintained.

Next, the structure of the joint portion between the high-temperature turbine rotor constituent part 113*a* and the low-temperature turbine rotor constituent part 113*b* will be described with reference to FIG. 2 to FIG. 5.

Figure 2:
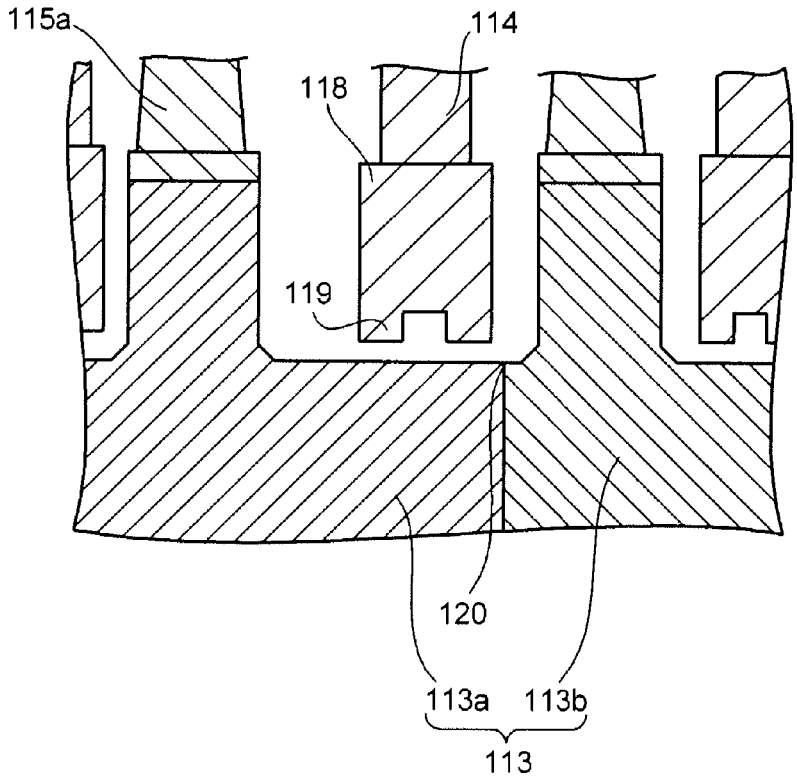
FIG. 2 is a view showing part of a cross section of a joint portion between a high-temperature turbine rotor constituent part and a low-temperature turbine rotor constituent part which are connected by welding.

FIG. 2 is a view showing part of a cross section of a joint portion between the high-temperature turbine rotor constituent part 113*a* and the low-temperature turbine rotor constituent part 113*b* which are connected by welding. Further, FIG. 3 to FIG. 5 are views each showing part of a cross section of a joint portion between the high-temperature turbine rotor constituent part 113*a* and the low-temperature turbine rotor constituent part 113*b* which are connected by bolting.

As shown in FIG. 2, the high-temperature turbine rotor constituent part 113*a* and the low-temperature turbine rotor constituent part 113*b* are connected by welding on a downstream side of the nozzle 114 positioned on an immediate downstream side of the moving blade 115*a* on the stage where the steam temperature becomes 550° C., whereby a joint portion 120 is formed. By thus connecting the high-temperature turbine rotor constituent part 113*a* and the low-temperature turbine rotor constituent part 113*b* by welding, it is possible to reduce an area occupied by the joint portion 120 to a minimum.

Figure 3:
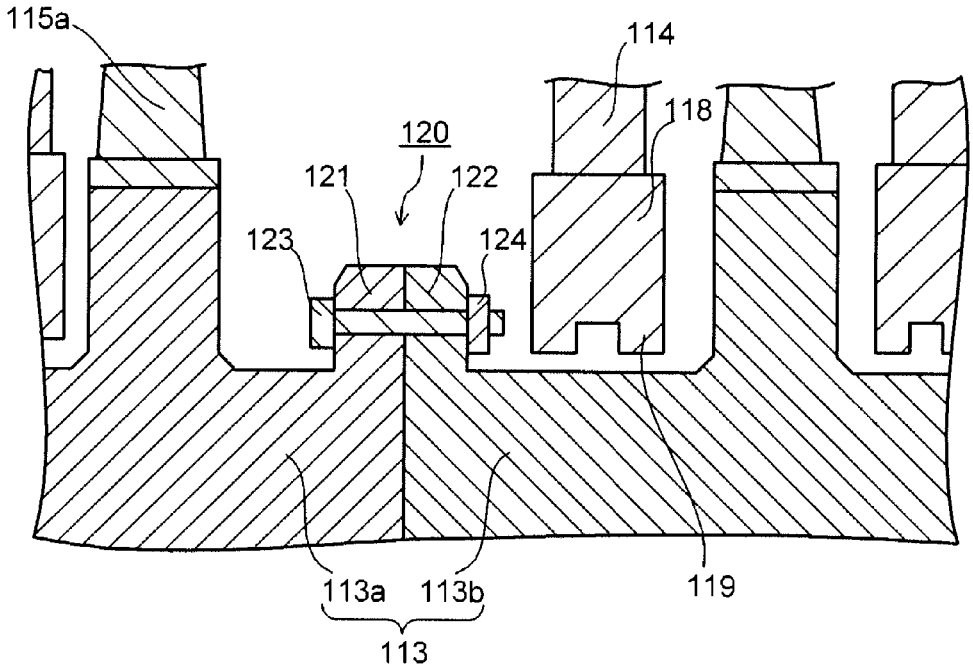
FIG. 3 is a view showing part of a cross section of a joint portion between the high-temperature turbine rotor constituent part and the low-temperature turbine rotor constituent part which are connected by bolting.

Another possible structure is, as shown in FIG. 3, that flange portions 121, 122 protruding outward in a radial direction of the turbine rotor 113 are formed in joint end portions of the high-temperature turbine rotor constituent part 113*a* and the low-temperature turbine rotor constituent part 113*b* respectively, and the both flange portions 121, 122 are bolt-connected with a bolt 123 and a nut 124. The joint portion 120 by the bolt-connection is positioned on an upstream side of the nozzle 114 positioned on an immediate downstream side of the moving blade 115*a* on the stage where the steam temperature becomes 550° C. By such bolt connection, it is possible to prevent thermal stress from occurring on a joint surface due to a difference in coefficient of linear expansion between the materials forming the high-temperature turbine rotor constituent part 113*a* and the low-temperature turbine rotor constituent part 113*b*.

Figure 4:
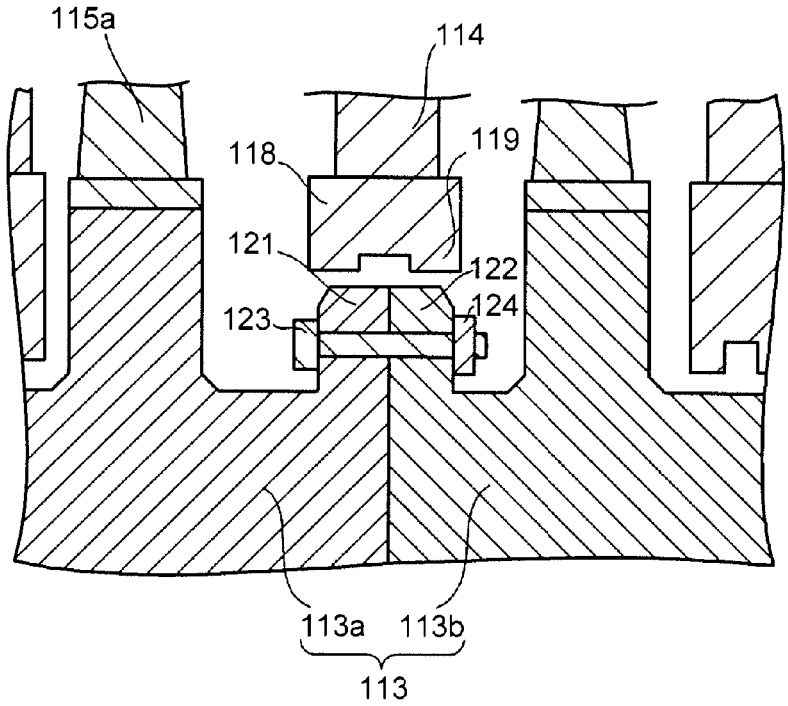
FIG. 4 is a view showing part of a cross section of a joint portion between the high-temperature turbine rotor constituent part and the low-temperature turbine rotor constituent part which are connected by bolting.
Figure 5:
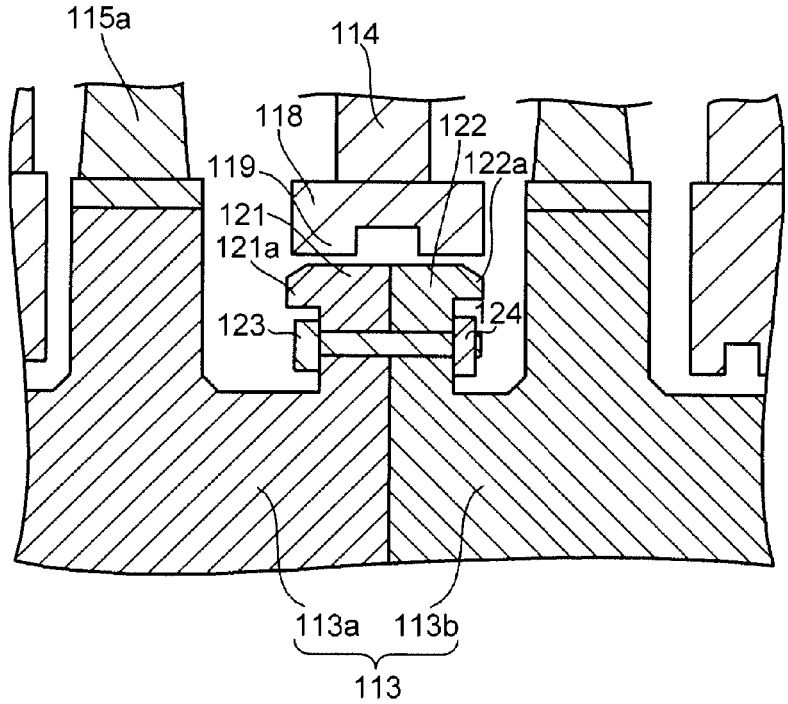
FIG. 5 is a view showing part of a cross section of a joint portion between the high-temperature turbine rotor constituent part and the low-temperature turbine rotor constituent part which are connected by bolting.

Further, as shown in FIG. 4, the joint portion by the bolt connection may be disposed to face the nozzle labyrinth 119. By thus positioning the joint portion, it is possible to shorten the whole length of the turbine rotor 113 compared with the case of the bolt connection shown in FIG. 3.

Further, as shown in FIG. 5, protruding portions 121*a*, 122*a* protruding to sides different from the joint surface where the high-temperature turbine rotor constituent part 113*a* and the low-temperature turbine rotor constituent part 113*b* are joined and preventing the exposure of the bolt 123 and the nut 124 in the radial direction of the turbine rotor 113 may be provided along outer peripheral edges of the flange portions 121, 122 of the high-temperature turbine rotor constituent part 113*a* and the low-temperature turbine rotor constituent part 113*b* respectively. That is, the bolt 123 and the nut 124 do not protrude in the axial direction of the turbine rotor 113 but are housed in a recessed portion formed by the protruding portions 121*a*, 122*a*, the turbine rotor 113, and the flange portions 121, 122. By thus providing the protruding portions 121*a*, 122*a*, it is possible to prevent scattering of the bolt 123 and the nut 124.

Further, the connection of the high-temperature turbine rotor constituent part 113*a* and the low-temperature turbine rotor constituent part 113*b* in a joint portion 126 formed at a position corresponding to the nozzle 114*a* on the first stage, though not shown, can be realized by the above-described welding or bolting. In this case, it is also possible to obtain the same operation and effect as are obtained by the above-described welding or bolting.

Next, the operation in the reheat steam turbine 100 will be described with reference to FIG. 1.

The steam whose temperature is 620° C. or higher flowing into the nozzle box 116 in the reheat steam turbine 100 via the steam inlet pipe 130 passes through the steam channel between the nozzles 114 fixed to the inner casing 110 and the moving blades 115 implanted in the turbine rotor 113 to rotate the turbine rotor 113. Further, most of the steam having finished expansion work passes through a discharge path 125 to be discharged out of the reheat steam turbine 100 and flows into a boiler through, for example, a low-temperature reheating pipe.

Incidentally, the above-described reheat steam turbine 100 may include a structure to introduce, as cooling steam, part of the steam having finished the expansion work to an area between the inner casing 110 and the outer casing 111 to cool the outer casing 111 and the inner casing 110. In this case, the cooling steam is discharged through a gland sealing part 127*a* or the discharge path 125. It should be noted that a method of introducing the cooling steam is not limited to this, and for example, steam extracted from a stage in the middle of the reheat steam turbine 100 or steam extracted from another steam turbine may be used as the cooling steam.

As described above, according to the reheat steam turbine 100 of the first embodiment and the turbine rotor 113 penetratingly provided in the reheat steam turbine 100, the Ni-based alloy which is a corrosion and heat resistant material is used only in the high-temperature parts, in the turbine rotor 113 and the inner casing 110, whose temperature exceeds a tolerable temperature of a conventional material (for example, ferritic heat resistant steel) determined by mechanical strength and corrosion resistance, so that they can be driven with high-temperature steam at 620° C. or higher to be able to maintain performances such as predetermined thermal efficiency, and they are also highly cost efficient.

Second Embodiment

Figure 6:
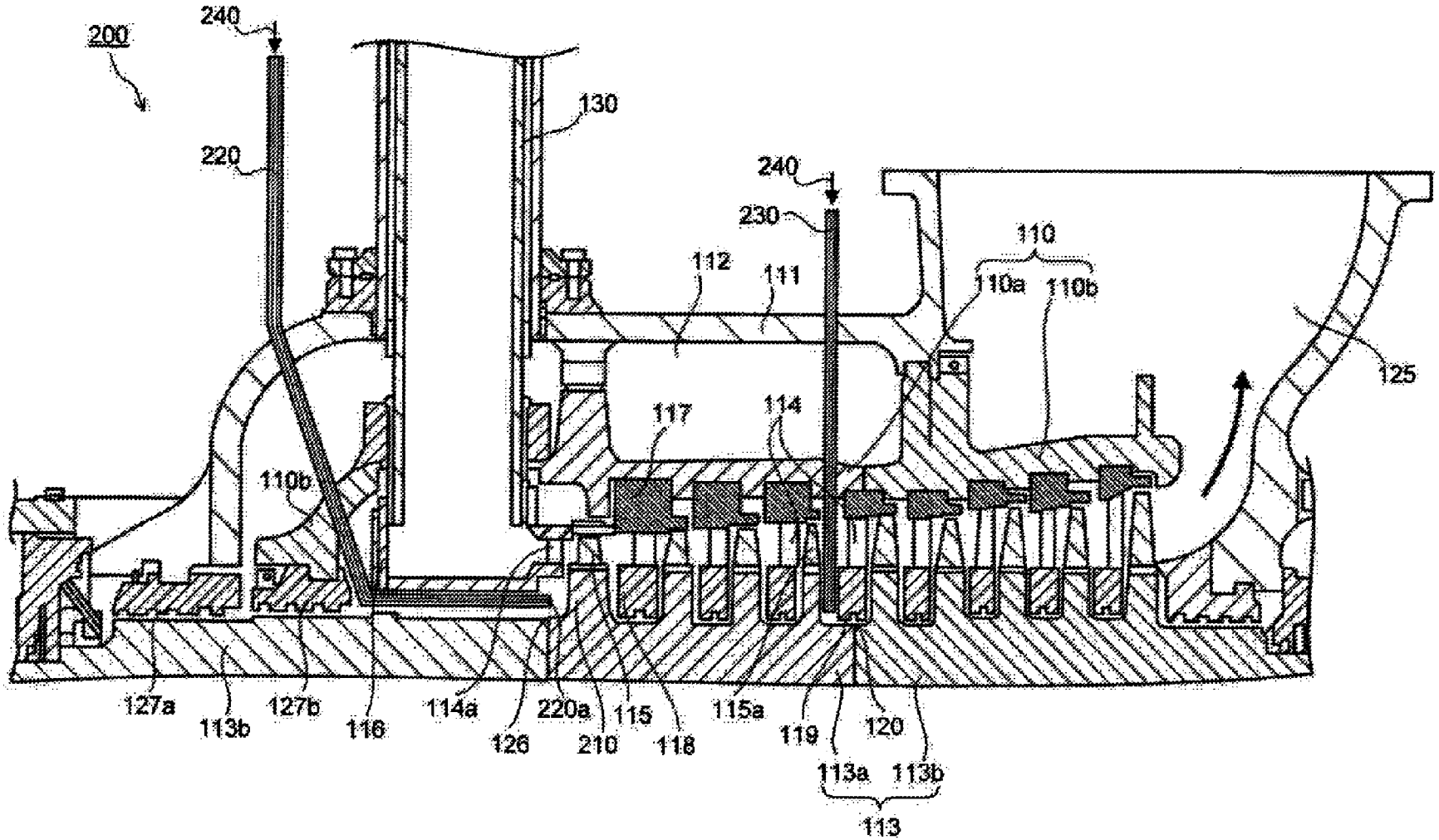
FIG. 6 is a view showing a cross section of an upper casing part of a reheat steam turbine of a second embodiment.

FIG. 6 is a view showing a cross section of an upper casing part of a reheat steam turbine 200 of a second embodiment. Here, the reheat steam turbine 200 of the second embodiment includes cooling parts to introduce cooling steam, in addition to the structure of the reheat steam turbine 100 of the first embodiment. The structure and materials except those of the cooling parts are the same as those of the reheat steam turbine 100 of the first embodiment, and therefore, the same reference numerals and symbols are used to designate the same constituent elements as those of the reheat steam turbine 100 of the first embodiment and they will be described only briefly or will not be repeatedly described.

As shown in FIG. 6, the reheat steam turbine 200 includes: a cooling steam supply pipe 220 disposed along a turbine rotor 113 and injecting cooling steam 240 from the vicinity of a joint portion 126 at a position corresponding to a nozzle 114*a* on a first stage to a wheel part 210 corresponding to a moving blade 115 on a first stage; and a cooling steam supply pipe 230 disposed between a moving blade 115*a* on a stage where steam temperature becomes 550° C. and a nozzle 114 positioned on an immediate downstream side of the moving blade 115*a* and injecting the cooling steam 240 to the turbine rotor 113. These cooling steam supply pipes 220, 230 function as the cooling parts, and the cooling steam 240 injected from these cooling steam supply pipes 220, 230 cool the turbine rotor 113, joint portions 120, 126, further, an outer casing 111, an inner casing 110, and so on.

As the cooling steam 240, usable is, for example, steam extracted from a high-pressure turbine, a boiler, or the like, steam extracted from a stage in the middle of the reheat steam turbine 200, or steam discharged to a discharge path 125 of the reheat steam turbine 200, and its supply source is appropriately selected based on a set temperature of the cooling steam 240.

Next, the structure of a joint portion between a high-temperature turbine rotor constituent part 113*a* and a low-temperature turbine rotor constituent part 113*b* will be described with reference to FIG. 7 to FIG. 10.

Figure 7:
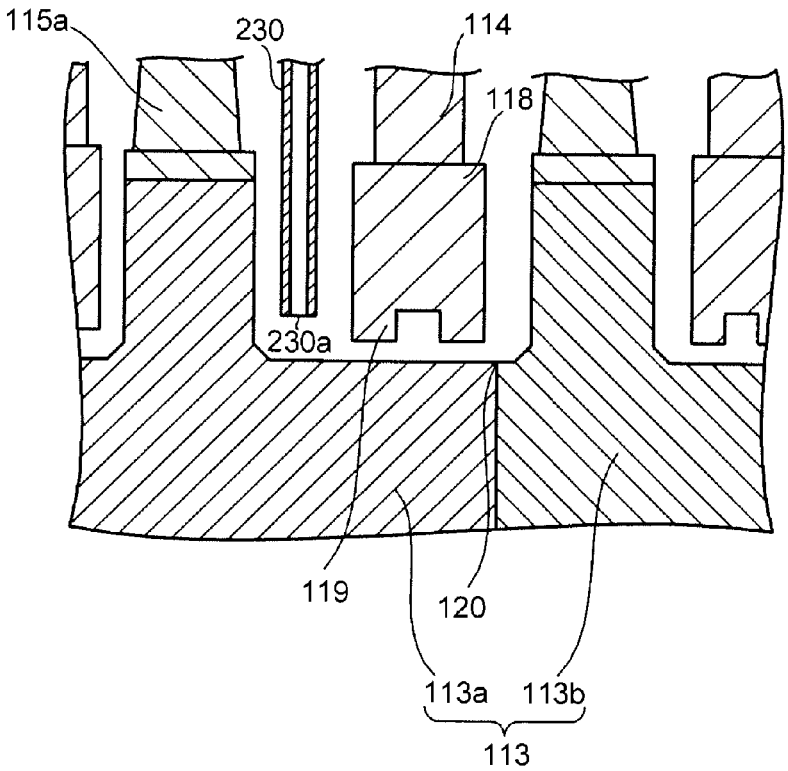
FIG. 7 is a view showing part of a cross section of a joint portion between a high-temperature turbine rotor constituent part and a low-temperature turbine rotor constituent part which are connected by welding, and also showing a cooling part.
Figure 8:
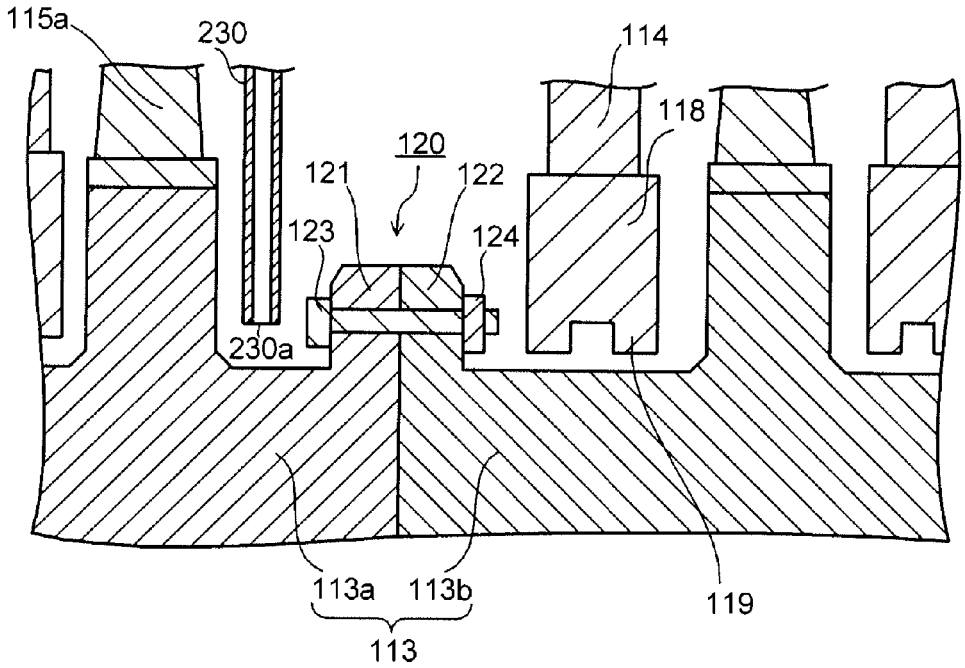
FIG. 8 is a view showing part of a cross section of a joint portion between the high-temperature turbine rotor constituent part and the low-temperature turbine rotor constituent part which are connected by bolting, and also showing the cooling part.
Figure 9:
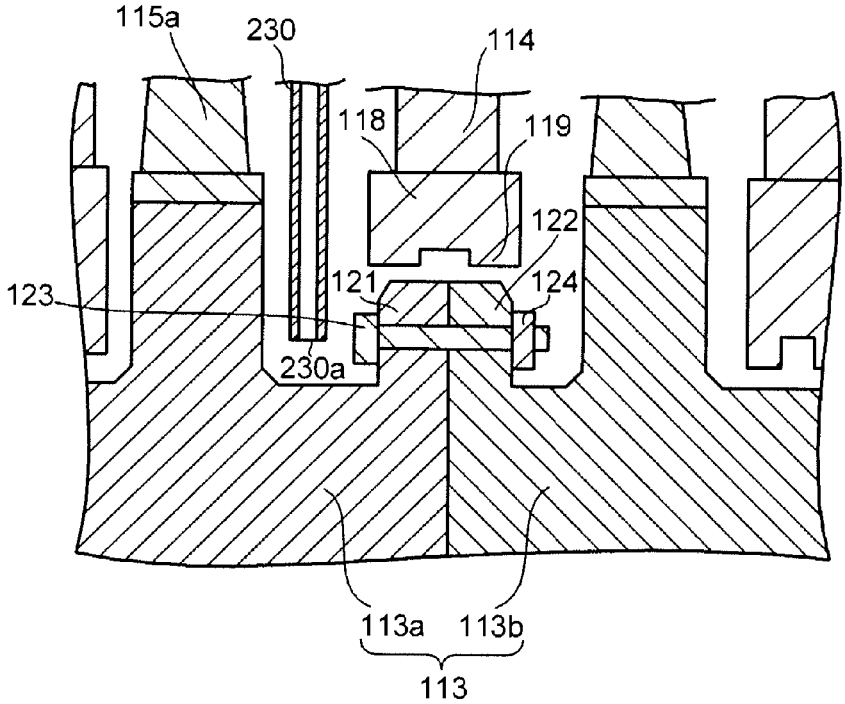
FIG. 9 is a view showing part of a cross section of a joint portion between the high-temperature turbine rotor constituent part and the low-temperature turbine rotor constituent part which are connected by bolting, and also showing the cooling part.
Figure 10:
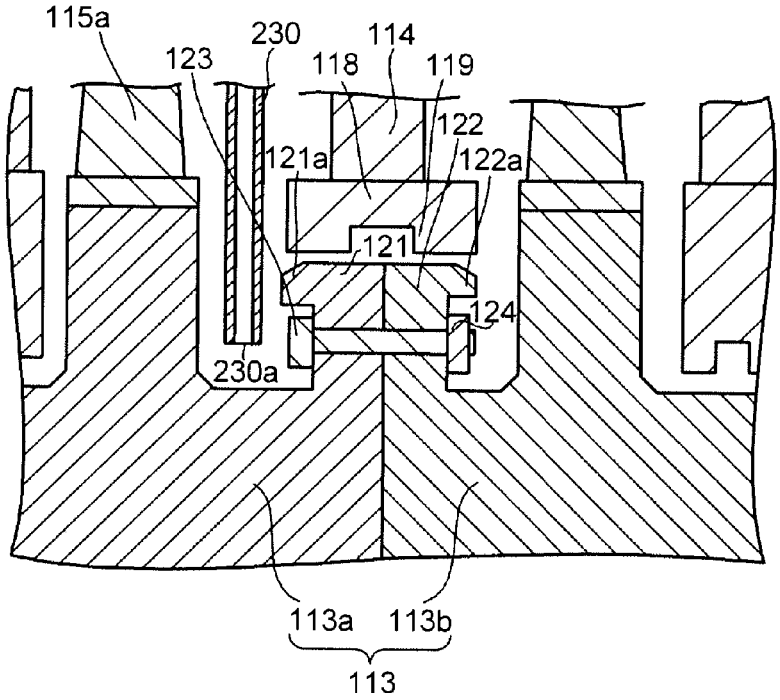
FIG. 10 is a view showing part of a cross section of a joint portion between the high-temperature turbine rotor constituent part and the low-temperature turbine rotor constituent part which are connected by bolting, and also showing the cooling part.

FIG. 7 is a view showing part of a cross section of the joint portion between the high-temperature turbine rotor constituent part 113*a* and the low-temperature turbine rotor constituent part 113*b* which are connected by welding, and also showing the cooling part. FIG. 8 to FIG. 10 are views each showing part of a cross section of a joint portion between the high-temperature turbine rotor constituent part 113*a* and the low-temperature turbine rotor constituent part 113*b* which are connected by bolting, and also showing the cooling part.

As shown in FIG. 7, the high-temperature turbine rotor constituent part 113*a* and the low-temperature turbine rotor constituent part 113*b* are connected by welding on a downstream side of the nozzle 114 positioned on an immediate downstream side of the moving blade 115*a* on the stage where the steam temperature becomes 550° C., whereby the joint portion 120 is formed. Further, the cooling steam supply pipe 230 is disposed between the moving blade 115*a* on the stage where the steam temperature becomes 550° C. and the nozzle 114 positioned on the immediate downstream side of the moving blade 115*a*, and its steam injection port 230*a* is directed to the high-temperature turbine rotor constituent part 113*a*, being a predetermined distance apart from the high-temperature turbine rotor constituent part 113*a*.

By thus connecting the high-temperature turbine rotor constituent part 113*a* and the low-temperature turbine rotor constituent part 113*b* by welding, it is possible to reduce an area occupied by the joint portion 120 to a minimum. Further, by supplying the cooling steam 240 to an area between the moving blade 115*a* on the stage where the steam temperature becomes 550° C. and the nozzle 114 positioned on the immediate downstream side of the moving blade 115*a*, it is possible to cool the joint portion 120 and the high-temperature turbine rotor constituent part 113*a* near the joint portion 120, so that it is possible to prevent the occurrence of thermal stress in the joint portion 120 and heat conduction to the low-temperature turbine rotor constituent part 113*b* side.

Another possible structure is, as shown in FIG. 8, that flange portions 121, 122 protruding outward in a radial direction of the turbine rotor 113 are formed in joint end portions of the high-temperature turbine rotor constituent part 113*a* and the low-temperature turbine rotor constituent part 113*b* respectively, and the both flange portions 121, 122 are bolt-connected with a bolt 123 and a nut 124. The cooling steam supply pipe 230 is disposed between the moving blade 115*a* on the stage where the steam temperature becomes 550° C. and the flange portion 121 of the high-temperature turbine rotor constituent part 113*a* positioned on the immediate downstream side of the moving blade 115*a*, and its steam injection port 230*a* is directed to the high-temperature turbine rotor constituent part 113*a*, being a predetermined distance apart from the high-temperature turbine rotor constituent part 113*a*. Further, the joint portion 120 by the bolt connection is positioned between the cooling steam supply pipe 230 and the nozzle 114 positioned on the downstream side of the moving blade 115*a* on the stage where the steam temperature becomes 550° C.

By such bolt connection and the supply of the cooling steam 240, it is possible to prevent thermal stress from occurring in a joint surface due to a difference in coefficient of linear expansion between materials forming the high-temperature turbine rotor constituent part 113*a* and the low-temperature turbine rotor constituent part 113*b*. Further, by supplying the cooling steam, it is possible to prevent heat conduction to the low-temperature turbine rotor constituent part 113*b* side.

Another possible structure is, as shown in FIG. 9, that the joint portion by the bolt connection is disposed to face a nozzle labyrinth 119, and the cooling steam supply pipe 230 is positioned between the moving blade 115*a* on the stage where the steam temperature becomes 550° C. and the flange portion 121 of the high-temperature turbine rotor constituent part 113*a* positioned on an immediate downstream side of the moving blade 115*a*. By thus positioning the joint portion, it is possible to shorten the whole length of the turbine rotor 13 compared with the case of the bolt connection shown in FIG. 8. Moreover, by supplying the cooling steam, it is possible to prevent heat conduction to the low-temperature turbine rotor constituent part 113*b* side.

Further, as shown in FIG. 10, protruding portions 121*a*, 122*a* protruding to a side different from the joint surface where the high-temperature turbine rotor constituent part 113*a* and the low-temperature turbine rotor constituent part 113*b* are joined and preventing the exposure of the bolt 123 and the nut 124 in the radial direction of the turbine rotor 113 may be provided along outer peripheral edges of the flange portions 121, 122 of the high-temperature turbine rotor constituent part 113*a* and the low-temperature turbine rotor constituent part 113*b* respectively. That is, the bolt 12 and the nut 124 do not protrude in the axial direction of the turbine rotor 113 but are housed in a recessed portion formed by the protruding portions 121*a*, 122*a*, the turbine rotor 113, and the flange portions 121, 122. By thus providing the protruding portions 121*a*, 122*a*, it is possible to prevent scattering of the bolt 123 and the nut 124.

Further, as shown in FIG. 6, the cooling steam supply pipe 220 is disposed along the turbine rotor 113, and its steam injection port 220*a* is positioned near the joint portion 126 at a position corresponding to the nozzle 114*a* on the first stage and is directed to the wheel part 210 corresponding to the moving blade 115 on the first stage. From this steam injection port 220*a*, the cooling steam 240 is injected toward the wheel part 210.

By thus supplying the cooling steam 240, it is possible to prevent heat conduction from the wheel part 210 corresponding to the moving blade 115*a* on the first stage where the high-temperature steam at 620° C. or higher passes, to the low-temperature turbine rotor constituent part 113*b* side via the high-temperature turbine rotor constituent part 113*a*. Moreover, the cooling steam 240 also cools the joint portion 126 and its vicinity.

Incidentally, the structure where the joint portion 126 at the position corresponding to the nozzle 114*a* on the first stage is formed by the weld connection as shown in FIG. 6 is described here, but the joint portion 126 may be formed by the bolt connection similarly to the above-described joint portion 120 on the downstream side. In this case, the cooling steam 240 is preferably supplied to an area between the joint portion 126 by the bolt connection and the wheel part 210 corresponding to the moving blade 115 on the first stage. At this time, the steam injection port 220*a* of the cooling steam supply pipe 220 is preferably directed to the wheel part 210 corresponding to the moving blade 115 on the first stage or the high-temperature turbine rotor constituent part 113*a*.

Here, the behavior of the cooling steam 240 will be described.

First, the cooling steam 240 injected from the steam injection port 220*a* of the cooling steam supply pipe 220 will be described with reference to FIG. 6.

The cooling steam 240 injected from the steam injection port 220*a* of the cooling steam supply pipe 220 collides with the wheel part 210 corresponding to the moving blade 115 on the first stage to cool the wheel part 210, and further comes into contact with the joint portion 126 to cool the joint portion 126 and its vicinity. Then, the cooling steam 240 passes through the gland sealing part 127*b*, and part thereof flows between the outer casing 111 and the inner casing 110 to cool the both casings. Further, the cooling steam 240 is introduced into a heat chamber 112 to be discharged through the discharge path 125. On the other hand, the rest of the cooling steam 240 having passed through the gland sealing part 127*b* passes through a gland sealing part 127*a* to be discharged.

Next, the cooling steam 240 injected from the steam injection port 230*a* of the cooling steam supply pipe 230 will be described with reference to FIG. 7 to FIG. 10.

In the structure shown in FIG. 7, the cooling steam 240 injected from the steam injection port 230*a* of the cooling steam supply pipe 230 collides with the high-temperature turbine rotor constituent part 113*a* on an immediate downstream side of the moving blade 115*a* on the stage where the steam temperature becomes 550° C. and cools the high-temperature turbine rotor constituent part 113*a*. Subsequently, the cooling steam 240 flows downstream between the nozzle labyrinth 119 and the high-temperature turbine rotor constituent part 113*a* to cool the joint portion 120 and its vicinity.

In the structure shown in FIG. 8, the cooling steam 240 injected from the steam injection port 230*a* of the cooling steam supply pipe 230 collides with the high-temperature turbine rotor constituent part 113*a* on the immediate downstream side of the moving blade 115*a* on the stage where the steam temperature becomes 550° C. and cools the high-temperature turbine rotor constituent part 113*a*, and further cools the flange portions 121, 122 being the joint portion 120. Subsequently, the cooling steam 240 flows downstream between the nozzle labyrinth 119 and the low-temperature turbine rotor constituent part 113*b* while cooling the both.

In the structures shown in FIG. 9 and FIG. 10, the cooling steam 240 injected from the steam injection port 230*a* of the cooling steam supply pipe 230 collides with the high-temperature turbine rotor constituent part 113*a* on the immediate downstream side of the moving blade 115*a* on the stage where the steam temperature becomes 550° C. and cools the high-temperature turbine rotor constituent part 113*a*. Subsequently, the cooling steam 240 flows downstream between the nozzle labyrinth 119 and the flange portions 121, 122 to cool the flange portions 121, 122 being the joint portion 120.

As described above, the cooling method by the cooling steam 240 injected from the steam injection port 220*a* of the cooling steam supply pipe 220 shown in FIG. 6 is a method to inject the cooling team 240 locally to the wheel part 210 near the joint portion 126 and can reduce a supply amount of the cooling steam 240 to a minimum. Consequently, blade cascade performance which becomes lower if the cooling steam 240 flows into a channel for a working steam from an area between the wheel parts 210 and the nozzle diaphragm inner rings 118 can be maintained at an equivalent level to that in a conventional steam turbine where the cooling steam is not supplied, and internal efficiency of the turbine itself can be improved. Further, it is also possible to cool the outer casing 111, the inner casing 110, and so on by the cooling steam 240 which has passed through the gland sealing part 127*b*. Further, the steam injection port 220*a* of the cooling steam supply pipe 220 is directed to the wheel part 210 corresponding to the moving blade 115 on the first stage and is capable of spraying the cooling steam 240 at a predetermined velocity, resulting in improved heat conductivity, so that the high-temperature turbine rotor constituent part 113*a* can be effectively cooled.

Further, as described above, the cooling methods by the cooling steam 240 injected from the steam injection port 230*a* of the cooling steam supply pipe 230 shown in FIG. 7 to FIG. 10 are methods to inject the cooling steam 240 locally to the high-temperature turbine rotor constituent part 113*a* near the joint portion 120, and are capable of reducing a supply amount of the cooling steam 240 to a minimum. Consequently, blade cascade performance which becomes lower if the cooling steam 240 flows into the channel for the working steam from the area between the wheel parts 210 and the nozzle diaphragm inner rings 118 can be maintained at an equivalent level to that of a conventional steam turbine where the cooling steam is not supplied, and internal efficiency of the turbine itself can be improved. Further, the steam injection port 230*a* of the cooling steam supply pipe 230 is directed to the high-temperature turbine rotor constituent part 113*a* and is capable of spraying the cooling steam 240 at a predetermined velocity, resulting in improved heat conductivity, so that the high-temperature turbine rotor constituent part 113*a* can be effectively cooled.

Hitherto, the present invention has been concretely described based on the embodiments, but the present invention is not limited to these embodiments, and can be variously modified within a range not departing from the spirit of the present invention. Further, the steam turbine and the turbine rotor of the present invention are applicable to a steam turbine to which high-temperature steam at 620° C. or higher is introduced.

What is claimed is:

1. A steam turbine having a turbine rotor to which high-temperature steam at 620° C. or higher is introduced, comprising:

a high-temperature turbine rotor constituent part positioned in an area extending from a nozzle on a first stage to a moving blade on a stage where temperature of the steam becomes 550° C., the high-temperature turbine rotor constituent part being made of a corrosion and heat resistant material;

low-temperature turbine rotor constituent parts connected to and sandwiching the high-temperature turbine rotor constituent part, the low-temperature turbine rotor constituent part being made of a material different from the material of the high-temperature turbine rotor constituent part;

a joint portion positioned on an upstream side out of joint portions on an outer surface between the high-temperature turbine rotor constituent part and the low-temperature turbine rotor constituent part, the joint portion positioned on the upstream side being formed at a position corresponding to the nozzle on the first stage;

a joint portion positioned on a downstream side out of joint portions on an outer surface between the high-temperature turbine rotor constituent part and the low-temperature turbine rotor constituent part, the joint portion positioned on the downstream side being formed at a position on a downstream side of a nozzle positioned on an immediate downstream side of a moving blade on a stage where temperature of the steam becomes 550° C.; and a cooling part configured to cool the joint portion on the downstream side out of the joint portions, the cooling part supplying a cooling steam to the upstream side of the nozzle positioned on the immediate downstream side of the moving blade on the stage where the steam temperature becomes 550° C.

2. The steam turbine according to claim 1, wherein the corrosion and heat resistant material forming the high-temperature turbine rotor constituent part is a Ni-based alloy, and the material forming the low-temperature turbine rotor constituent parts is ferritic heat resistant steel.

3. The steam turbine according to claim 1, wherein the high-temperature turbine rotor constituent part and the low-temperature turbine rotor constituent parts are connected by welding or bolting.

4. The steam turbine according to claim 1, wherein, in a casing of the steam turbine connected to a nozzle diaphragm, a constituent portion covering the area in which the high-temperature turbine rotor constituent part is penetratingly provided is made of a corrosion and heat resistant material.

5. A turbine rotor penetratingly provided in a steam turbine to which high-temperature steam at 620° C. or higher is introduced, comprising:

a high-temperature turbine rotor constituent part positioned in an area extending from a nozzle on a first stage in the steam turbine to a moving blade on a stage where temperature of the steam becomes 550° C., high-temperature turbine rotor constituent part being made of a corrosion and heat resistant material; and low-temperature turbine rotor constituent parts connected to and sandwiching the high-temperature turbine rotor constituent part, the low-temperature turbine rotor constituent part being made of a material different from the material of the high-temperature turbine rotor constituent part;

a joint portion positioned on an upstream side out of joint portions on an outer surface between the high-temperature turbine rotor constituent part and the low-temperature turbine rotor constituent part, the joint portion positioned on the upstream side being formed at a position corresponding to the nozzle on the first stage in the steam turbine; and a joint portion positioned on a downstream side out of joint portions on an outer surface between the high-temperature turbine rotor constituent part and the low-temperature turbine rotor constituent part, the joint portion positioned on the downstream side being formed at a position on a downstream side of a nozzle in the steam turbine positioned on an immediate downstream side of a moving blade on a stage where temperature of the stream becomes 550° C.

6. The turbine rotor according to claim 5, wherein the corrosion and heat resistant material forming the high-temperature turbine rotor constituent part is a Ni-based alloy, and the material forming the low-temperature turbine rotor constituent parts is ferritic heat resistant steel.

7. The turbine rotor according to claim 5, wherein the high-temperature turbine rotor constituent part and the low-temperature turbine rotor constituent parts are connected by welding or bolting.

* * * * *